US005726527A

United States Patent [19]

Gassler et al.

[11] Patent Number: 5,726,527

[45] Date of Patent: Mar. 10, 1998

[54] GRID ELECTRODE STRUCTURE FOR A CATHODE RAY TUBE

[75] Inventors: Gerhard Gassler, Ulm; Gerhard Hörsch, Laichingen, both of Germany

[73] Assignee: AEG Elektronische Röhren GmbH, Ulm, Germany

[21] Appl. No.: 713,086

[22] Filed: Sep. 12, 1996

[30] Foreign Application Priority Data

Sep. 14, 1995 [DE] Germany ..... 195 34 124.4

[51] Int. Cl.[6] ..... H01J 29/48

[52] U.S. Cl. ..... 313/447; 313/446

[58] Field of Search ..... 313/446, 447, 313/293, 414, 444, 448, 449, 451, 456

[56] References Cited

U.S. PATENT DOCUMENTS 4,500,809 2/1985 Odenthal et al. ..... 313/447

FOREIGN PATENT DOCUMENTS 30 10 807 10/1980 Germany .

*Primary Examiner*—Gerard R. Strecker
*Assistant Examiner*—Vip Patel
*Attorney, Agent, or Firm*—Spencer & Frank

[57] ABSTRACT

A grid electrode for a cathode ray tube includes a ceramic carrier lamina having a thickness of up to about 0.5 mm and opposite lamina surfaces; a throughgoing aperture defined in the carrier lamina by a wall portion thereof extending between the lamina surfaces; and a metallized surface portion forming part of one of the lamina surfaces. The metallized surface portion is situated in a zone of the aperture.

7 Claims, 1 Drawing Sheet

GRID ELECTRODE STRUCTURE FOR A CATHODE RAY TUBE

CROSS REFERENCE TO RELATED APPLICATION

This application claims the priority of German Application No. 195 34 124.4 filed Sep. 14, 1995, which is incorporated herein by reference.

BACKGROUND OF THE INVENTION

This invention relates to a cathode ray tube which has at least one grid electrode provided with an aperture and supported on a ceramic carrier body.

X-ray tubes of the above-outlined type serve particularly as display tubes. The capacities which are determined by the cathode ray tube structure, particularly the capacities between two adjoining electrodes involve a problem because the frequency limit set by such capacities is too low as concerns the requirements for increasing resolution and contrast of the display.

German Offenlegungsschrift (application published without examination) No. 30 10 807 discloses a cathode ray tube in which, for reducing the grid capacity, a ceramic carrier body has a planar side which supports a first grid electrode and an opposite, conically depressed side which supports a frustoconical second grid electrode.

SUMMARY OF THE INVENTION

It is an object of the invention to provide an improved cathode ray tube which has a control electrode provided with an aperture and which makes possible a shift of the limit frequency to higher values.

This object and others to become apparent as the specification progresses, are accomplished by the invention, according to which, briefly stated, the cathode ray tube includes a grid electrode having a ceramic carrier lamina of a thickness of up to about 0.5 mm; a throughgoing aperture defined in the carrier lamina by a wall portion thereof extending between the lamina surfaces through the thickness of the lamina; and a metallized surface portion which forms part of one of the lamina surfaces and which is situated in a zone of the aperture.

By virtue of the cathode ray tube structured according to the invention, the total capacity of the electrode arrangement is significantly reduced while the extent to which the electron beam may be controlled is altered only unsubstantially, if at all, as compared to a full, planar metallic grid electrode. The electrode configuration according to the invention may be applicable to a plurality of electrodes of the cathode ray tube. The thin ceramic lamina is inexpensive to manufacture, easy to handle and permits a compact arrangement, particularly in systems having a plurality of grid electrodes.

DESCRIPTION OF THE PREFERRED EMBODIMENT

Figure 1:
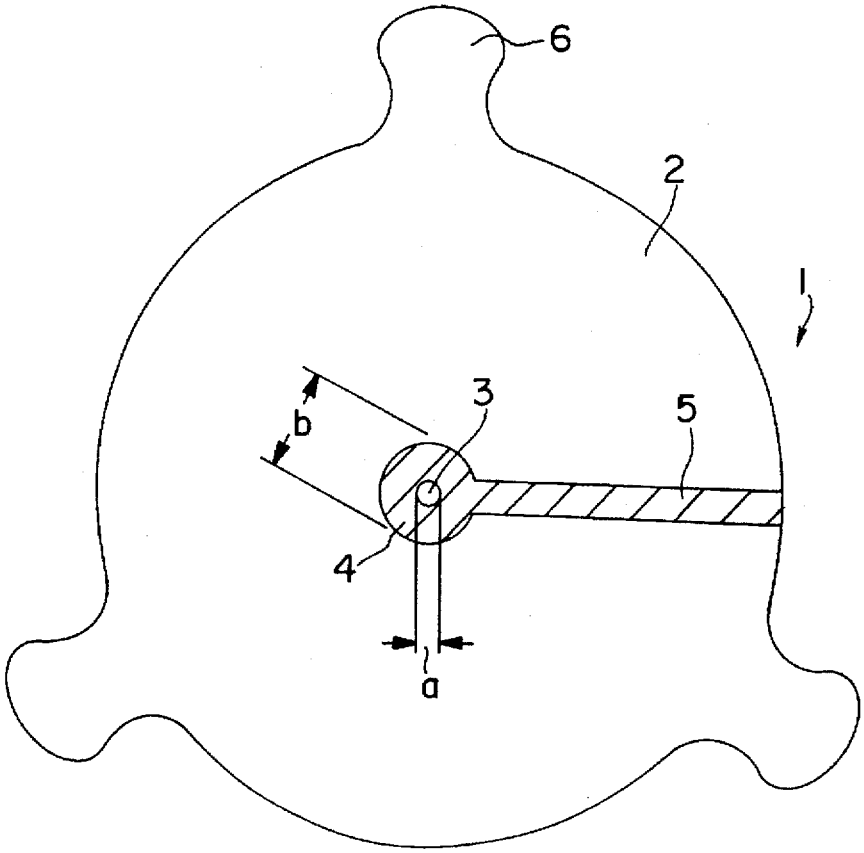
FIG. 1 is a schematic top plan view of a grid electrode according to the invention.

FIG. 1 shows a grid electrode according to the invention generally designated at 1, including a carrier body 2 made of a nonconductive material and having opposite surfaces. The carrier body 2 is provided with a central aperture 3 defined by a carrier body wall passing through the thickness of the body between the two opposite surfaces thereof. The aperture 3 is surrounded by an annular metallized surface portion 4 of one of the surfaces of the carrier body 2. A conductor strip 5 extends from the metallized surface portion 4 for contacting a control terminal. The carrier body 2 is preferably approximately circular and has on its periphery a plurality of radially outwardly projecting tabs 6 for mechanically fixing (immobilizing) the carrier body 2 on insulating carrier rods 15 within a cathode ray tube. Since the conductor strip 5 performs solely an electric function and thus has no mechanical role, its width and thus its field effect may be maintained small. The aperture 3 has a diameter a, whereas the metallized surface portion 4 has a diameter b.

Figure 2:
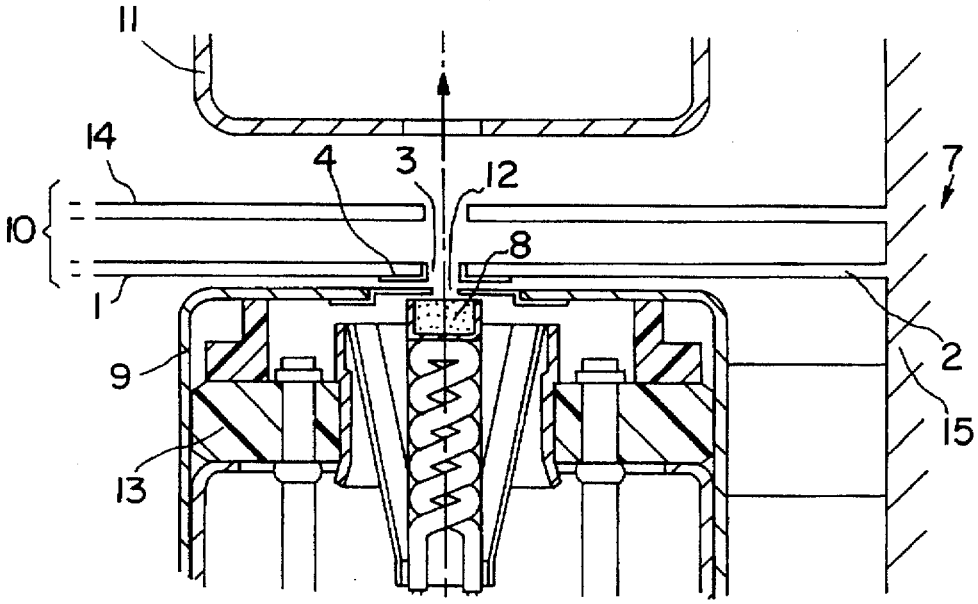
FIG. 2 is a sectional side elevational view of an electrode arrangement in a cathode ray tube according to the invention.

Turning to FIG. 2, the cathode ray tube generally designated at 7 has insulating carrier rods 15, a cathode 8, a bowl-shaped first grid electrode 9, a planar second grid electrode 10 and a bowl-shaped third grid electrode 11. The first grid electrode 9 is entirely of metal and has a central first aperture 12. The cathode 8 is secured in the first grid electrode 9 by means of an insulating cathode carrier 13. As viewed from the cathode 8, the second grid electrode 10 is arranged behind the first grid electrode 9 and is formed of two spaced individual electrodes 1 and 14. The third grid electrode 11 as well as additional, non-illustrated electrodes are disposed behind the second grid electrode 10. The capacity formed together by the grid electrode 9 and the grid electrode 1 are of particular significance regarding the capacitive properties of the grid electrode arrangement. The invention therefore is particularly advantageous if applied to the configuration of the grid electrode 1 whose aperture 3 is located in axial alignment with the aperture 12 of the grid electrode 9. The metallized surface portion 4 of the second grid electrode 1 in the region of the aperture 3 and the first grid electrode 9 are at different potentials. A modulation of the emitted electron beam is effected conventionally by modulating the potential of the first grid electrode 9 while maintaining the potential of the second grid electrode 1 constant. Thus, such modulation is effected by the voltage between the two grid electrodes 1 and 9. The two grid electrodes 1 and 9 function as a condenser whose capacity limits the obtainable modulation frequency. By virtue of the inventive configuration of the grid electrode 1 as a nonconductive carrier body 2 with a metallized surface portion 4 in the zone of the aperture 3, the capacity of the condenser may be maintained low and thus a high limit-frequency may be obtained.

Reverting to FIG. 1, the exact dimensioning of the metallized surface portion 4 may be optimized as a structural parameter dependent upon the conditions of the individual constructions. The area of one surface of the carrier body 2 is a multiple of the area of the metallized surface portion 4. The diameter b of the metallized surface portion 4 is preferably less than 20 times the diameter a of the aperture 3 and is preferably between twice and ten times the diameter a of the aperture, that is, $2a \leqq b \leqq 10a$. It has been found advantageous to select for the diameter b of the metallized surface portion 4 approximately five times the diameter a of the aperture 3.

By virtue of the arrangement according to the invention, compared to a second grid electrode formed conventionally as a metal disk, a substantial reduction of the capacity is obtained, for example, from 5 pF to 3 pF without an appreciable defocusing of the electron beam.

The carrier body 2 of the second grid electrode 1 is a ceramic lamina having a thickness in the range of preferably 0.1–0.5 mm. The metallized surface portion 4 may be made by conventional methods, for example, by vapor deposition or chemical separation, in conjunction with etching techniques and, if required, an additional galvanic reinforcement. As a metal, preferably hard-solderable MoMn is used which is galvanically reinforced with nickel. The metallized surface portion extends preferably also into the aperture 3, that is, the metallized surface portion 4 also covers that circular wall portion of the carrier body 2 which defines the aperture 3. The conductor strip 5 may be situated on either one of the sides of the carrier body (lamina) 2 in case the wall of the aperture is also metallized. The arrangement of the conductor strip 5 on that side of the carrier body 2 which is oriented towards the cathode 8 permits a structuring together with the metallized surface portion 4. As conductor strips a plurality of angularly uniformly distributed radial conductor strips may be used.

The cathode ray tube may have a plurality of grid electrodes structured according to the invention. The use of the inventive grid electrode as a first and/or second grid electrode in a multi-grid cathode ray tube is particularly advantageous because these grid electrodes have a particularly small mutual distance and therefore have the principal share of the overall electrode capacity.

It will be understood that the above description of the present invention is susceptible to various modifications, changes and adaptations, and the same are intended to be comprehended within the meaning and range of equivalents of the appended claims.

What is claimed is:

1. A grid electrode for a cathode ray tube comprising (a) a ceramic carrier lamina having a thickness of up to about 0.5 mm and opposite lamina surfaces;

(b) a throughgoing aperture defined in said carrier lamina by a wall portion thereof extending between said lamina surfaces; and (c) a metallized surface portion forming part of one of said lamina surfaces; said metallized surface portion being situated in a zone of said aperture.

2. The grid electrode as defined in claim 1, wherein said metallized surface portion surrounds said aperture.

3. The grid electrode as defined in claim 1, wherein said wall portion defining said aperture has a metallized surface connected with said metallized surface portion of the lamina surface.

4. The grid electrode as defined in claim 1, wherein said carrier lamina and said metallized surface portion have a generally circular shape and have respective diameters; further wherein the diameter of said metallized surface portion is smaller than twenty times the diameter of said aperture.

5. The grid electrode as defined in claim 4, wherein said diameter of said metallized surface portion is at least twice and at the most ten times the diameter of said aperture.

6. The grid electrode as defined in claim 1, wherein the area of one of said lamina surfaces is a multiple of the area of said metallized surface portion.

7. The grid electrode as defined in claim 6, further comprising a conductor strip extending from said metallized surface portion to an edge of said carrier lamina.

* * * * *